US009786158B2

(12) United States Patent
Beaver et al.

(10) Patent No.: US 9,786,158 B2
(45) Date of Patent: Oct. 10, 2017

(54) USING DEGREE OF CONFIDENCE TO PREVENT FALSE SECURITY SYSTEM ALARMS

(71) Applicant: ADT US HOLDINGS, INC., Boca Raton, FL (US)

(72) Inventors: Robert Beaver, West Palm Beach, FL (US); Ryan B. Petty, Parkland, FL (US); Thomas Nakatani, Aurora, CO (US); Mark Reimer, Fort Collins, CO (US); Clinton Masterson, San Francisco, CA (US); Tondria Leah Isaacs Lopeztello, Foothill Ranch, CA (US); Scot A. Hulshizer, Boca Raton, FL (US); Eric W. Gerling, Dexter, IA (US); Mollie Conway, Boca Raton, FL (US); Richard Charles Shuman, Speedway, IN (US); Brian Keith Angel, Jacksonville, FL (US); Shanen Leigh Pankrez, Grapevine, TX (US); Frank A. Cona, Tequesta, FL (US)

(73) Assignee: ADT US HOLDINGS, INC., Boca Raton, FL (US)

( * ) Notice: Subject to any disclaimer, the term of this patent is extended or adjusted under 35 U.S.C. 154(b) by 0 days.

(21) Appl. No.: 14/827,715

(22) Filed: Aug. 17, 2015

(65) Prior Publication Data

US 2016/0049071 A1 Feb. 18, 2016

Related U.S. Application Data

(60) Provisional application No. 62/037,953, filed on Aug. 15, 2014.

(51) Int. Cl.
*G08B 29/18* (2006.01)
*G08B 31/00* (2006.01)

(52) U.S. Cl.
CPC ..... *G08B 29/185* (2013.01); *G08B 29/188* (2013.01); *G08B 31/00* (2013.01)

(58) Field of Classification Search
CPC ..... G08B 29/185; G08B 29/188; G08B 31/00
See application file for complete search history.

(56) References Cited

U.S. PATENT DOCUMENTS 4,857,912 A 8/1989 Everett, Jr. et al.
7,106,193 B2 9/2006 Kovach
(Continued)

FOREIGN PATENT DOCUMENTS

EP 0654771 A1 5/1995

OTHER PUBLICATIONS

International Search Report (and Written Opinion) dated Oct. 21, 2015 for International Application No. PCT/US2015/045499, International Filing Date Aug. 17, 2015 consisting of 23 pages.
(Continued)

*Primary Examiner* — Leon Flores
(74) *Attorney, Agent, or Firm* — Christopher & Weisberg, P.A.

(57) ABSTRACT

A device and method for analyzing an event at a premises is provided. In one embodiment the device includes a processor and a memory configured to store executable instructions, which when executed by the processor, cause the processor to receive first event data related to the event at the premises, receive verification data related to the event at the premises, analyze the first event data in conjunction with the verification data, generate, based on the analysis, an indication of a probability that the event is an alarm event, and initiate at least one action based on the indication.

20 Claims, 7 Drawing Sheets

(56) References Cited

U.S. PATENT DOCUMENTS

| | | | | |
|---|---|---|---|---|
| 7,248,155 | B2 | 7/2007 | Wang et al. | |
| 7,298,253 | B2 | 11/2007 | Petricoin et al. | |
| 7,952,474 | B2 | 5/2011 | Kang et al. | |
| 9,013,294 | B1 * | 4/2015 | Trundle | G08B 25/001 340/501 |
| 2003/0107650 | A1 | 6/2003 | Colmenarez et al. | |
| 2006/0033625 | A1 * | 2/2006 | Johnson | G06Q 10/10 340/573.1 |
| 2007/0285511 | A1 | 12/2007 | Shafer et al. | |
| 2008/0272902 | A1 * | 11/2008 | Kang | G08B 29/183 340/506 |
| 2012/0086568 | A1 | 4/2012 | Scott | |
| 2014/0266699 | A1 * | 9/2014 | Poder | G08B 25/001 340/539.13 |
| 2016/0210832 | A1 * | 7/2016 | Williams | H04W 4/043 |

OTHER PUBLICATIONS

Davis Andrew L.: "An Integrated Solution for Effective Video Alarm Verification", Security Technology, 1997, Proceedings, The Institute of Electrical and Electronics Engineers 31st Annual 1997 International Carnahan Conference on Canberra, Act, Australia Oct. 15-17, 1997, New York, NY, USA, IEEE, US, Oct. 15, 1997, pp. 154-157, consisting of 4 pages.

PCT Written Opinion of the International Preliminary Examining Authority dated Jul. 2, 2016, for corresponding International Application No. PCT/US2015/045499; International Filing Date: Aug. 17, 2015 consisting of 11 pages.

PCT Notification of Transmittal of the International Preliminary Report on Patentability Form/PCT/IB/326 and International Preliminary Report on Patentability, for corresponding International Application No. PCT/US2015/045499; International Filing Date: Aug. 17, 2015 consisting of 35-pages.

* cited by examiner

USING DEGREE OF CONFIDENCE TO PREVENT FALSE SECURITY SYSTEM ALARMS

CROSS-REFERENCE TO RELATED APPLICATION

This application is related to and claims priority to U.S. Provisional Patent Application Ser. No. 62/037,953, filed Aug. 15, 2014, entitled METHOD FOR VERIFICATION OF AN ALARM EVENT USING OTHER DATA, the entirety of which is incorporated herein by reference.

STATEMENT REGARDING FEDERALLY SPONSORED RESEARCH OR DEVELOPMENT n/a

TECHNICAL FIELD

The present invention relates to alarm monitoring systems, and in particular to a method and system to verify an alarm event by analyzing event data in conjunction with verification data.

BACKGROUND

The desire to be safe and secure—as to oneself, one's family and friends, and one's property—is fundamental. As technology has improved over the years—such as with the creation of digital communications, cellular and other wireless networks, broadband and the Internet, more capable and less expensive computing equipment, and the development of additional event detection devices, with the ability to detect a wider arrange of event types,—so has the ability to protect one's home or property. It is common for businesses and homeowners to have an electronic system for detecting alarm event conditions (such as intrusion, fire, carbon monoxide, flooding, temperature conditions, appliance status, etc.) at their premises, which reports the event to a server or other system that notifies the user who can monitor the systems through their phone, personal digital assistant (PDA), etc., and/or remotely interact and control systems at their premises (such as lighting, thermostats, energy management devices, security systems, etc.). Typically, these systems may also provide alarm event information to a monitoring center that can contact first responders or take other action on the user's behalf.

These electronic alarm monitoring systems provide key advantages of detecting events prior to an occupant's detection of the event or in the occupant's absence, and they can function without the need for human supervision, interaction, or operation—detecting events and communicating the event data to a monitoring center, which is staffed with highly trained operators who can request a dispatch of first responders (such as paramedics, firefighters, and law enforcement officers) or take other action on behalf of the system owner in response to the alarm event.

However, transmitted alarm events sometimes occur due to user error, or are due to circumstances that do not necessitate a dispatch of first responders, i.e., a "false alarm". When such events occur, they risk an unnecessary burden on first responders, and may increase the cost of the alarm monitoring system to the home owner by generating fines or the use of additional hardware to help verify that the event is actually an alarm event.

It is known in the art that video verification methods can be used as a secondary indicator of whether an event has occurred for which first responders are needed. With video verification, an operator in the monitoring center can view pictures, video clips, or streaming video from the premises to better assess whether the alarm event is accompanied by suspicious visual indicators. These indicators may include signs of forced entry, damage to the premises, injury to an occupant of the premises, or visual evidence of unexpected people or vehicles at the premises.

However, video verification may also not show any clearly suspicious activity or just show what the occupant of the premises was doing at the time of the response. In such cases, follow up contact with the system owner or a designated contact may still be needed as a tertiary verification of whether there is a need for first responders. Although these methods may increase the reliability of alarm event indicators, they can be disadvantageous due to privacy implications, potential for added response time to actual alarm events, increased cost associated with human resources, and other concerns.

SUMMARY

The present invention advantageously provides a method and system for verifying an alarm event by analyzing event data in conjunction with verification data.

According to one embodiment of the invention, a device for analyzing an event at a premises is provided. The device includes a processor and a memory configured to store executable instructions, which when executed by the processor, cause the processor to receive first event data related to the event at the premises, receive verification data related to the event at the premises, analyze the first event data in conjunction with the verification data, generate, based on the analysis, an indication of a probability that the event is an alarm event, and initiate at least one action based on the indication.

According to one aspect of this embodiment of the invention, the indication of the probability that the event is an alarm event includes at least one of a percentage value representing a probability of whether the event is an alarm event, a color scheme representing one of a plurality of predefined levels of probability of whether the event is an alarm event, and one of a plurality of predefined levels of probability of whether the event is an alarm event. According to another aspect of this embodiment of the invention, the analyzing of the first event data in conjunction with the verification data includes running a rules engine to apply at least one rule to the event data and verification data to determine the probability that the event is an alarm event, the rules engine including at least one of logic functions and mathematical expressions.

According to another aspect of this embodiment of the invention, the analyzing of the first event data in conjunction with the verification data includes determining a first predefined alarm value associated with the first event data, determining at least one second predefined alarm value associated with the verification data, and adding the first predefined alarm value and the at least one second predefined alarm value to generate the likelihood that the event is an alarm event. According to another aspect of this embodiment of the invention, the at least one second predefined alarm value is a positive value. The positive value indicates that at least one sensor that provided the verification data has been triggered. The first predefined alarm value is a positive value. According to another aspect of this embodiment of the invention, the at least one second predefined alarm value is a negative value. The negative value indicates that at least one sensor that provided the verification data has not been triggered. The first predefined alarm value is a positive value.

According to another aspect of this embodiment of the invention, the at least one action includes at least one of updating the verification data, initiating a home automation, adjusting a home automation profile, actuating an alarm indicator, notifying at least one contact, notifying a monitoring center, notifying at least one first responder device, and transmitting the indication and at least a portion of the event data. According to another aspect of this embodiment of the invention, the first event data includes data from at least one of a door contact, a window contact, a carbon monoxide detector, a smoke detector, a glass break detector, a motion detector, a video camera, an audio sensor, an accelerometer, a vibration sensor, a keypad, a pressure sensor, a humidistat, a temperature sensor, a biometric device, an infrared image sensor, a vapor sensor, a wireless network router, a photosensor, a tamper switch, a GPS device, assets tag, a glucose meter, a blood pressure meter, a personal emergency response system (PERS) pendant, and a smart phone.

According to another aspect of this embodiment of the invention, the verification data includes at least one of profile data, statistical data and second event data different from first event data. The second event data includes data from at least one of a door contact, a window contact, a carbon monoxide detector, a smoke detector, a glass break detector, a motion detector, a video camera, an audio sensor, an accelerometer, a vibration sensor, a keypad, a pressure sensor, a humidistat, a temperature sensor, a biometric device, an infrared image sensor, a vapor sensor, a wireless network router, a photosensor, a tamper switch, a GPS device, assets tag, a glucose meter, a blood pressure meter, a personal emergency response system (PERS) pendant, and a smart phone.

According to another aspect of this embodiment of the invention, profile data includes at least one of information related to an occupant of the premises, a pet kept on the premises, smart phone data, structural details of the premises and geographic information associated with the premises. According to another aspect of this embodiment of the invention, the statistical data includes at least one of previous event data, trends of previous event data, biometric data, crime data and news data.

According to another embodiment of the invention, a method for analyzing an event at a premises is provided. First event data related to the event at the premises is received. Verification data related to the event at the premises is received. The first event data is analyzed in conjunction with the verification data. An indication of a probability that the event is an alarm event is generated based on the analysis. At least one action is initiated based on the indication.

According to another embodiment of this aspect, the indication of the probability that the event is an alarm event includes at least one of a percentage value representing a probability of whether the event is an alarm event, a color scheme representing one of a plurality of predefined levels of probability of whether the event is an alarm event, and one of a plurality of predefined levels of probability of whether the event is an alarm event.

According to another embodiment of this aspect, the analyzing of the first event data in conjunction with the verification data includes running a rules engine to apply at least one rule to the event data and verification data to determine the probability that the event is an alarm event, the rules engine including at least one of logic functions and mathematical expressions. According to another embodiment of this aspect, the analyzing of the first event data in conjunction with the verification data includes determining a first predefined alarm value associated with the first event data, determining at least one second predefined alarm value associated with the verification data, and adding the first predefined alarm value and the at least one second predefined alarm value to generate the likelihood that the event is an alarm event.

According to another embodiment of this aspect, the at least one second predefined alarm value is a positive value. The positive value indicates that at least one sensor that provided the verification data has been triggered. The first predefined alarm value is a positive value. According to another embodiment of this aspect, the at least one second predefined alarm value is a negative value. The negative value indicates that at least one sensor that provided the verification data has not been triggered. The first predefined alarm value is a positive value.

According to another embodiment of this aspect, the at least one action includes at least one of updating the verification data, initiating a home automation, adjusting a home automation profile, actuating an alarm indicator, notifying at least one contact, notifying a monitoring center, notifying at least one first responder device, and transmitting the indication and at least a portion of the event data. According to another embodiment of this aspect, the first event data includes data from at least one of a door contact, a window contact, a carbon monoxide detector, a smoke detector, a glass break detector, a motion detector, a video camera, an audio sensor, an accelerometer, a vibration sensor, a keypad, a pressure sensor, a humidistat, a temperature sensor, a biometric device, an infrared image sensor, a vapor sensor, a wireless network router, a photosensor, a tamper switch, a GPS device, assets tag, a glucose meter, a blood pressure meter, a personal emergency response system ("PERS") pendant, and a smart phone. According to another embodiment of this aspect, the verification data includes at least one of profile data, statistical data and second event data different from first event data. The second event data includes data from at least one of a door contact, a window contact, a carbon monoxide detector, a smoke detector, a glass break detector, a motion detector, a video camera, an audio sensor, an accelerometer, a vibration sensor, a keypad, a pressure sensor, a humidistat, a temperature sensor, a biometric device, an infrared image sensor, a vapor sensor, a wireless network router, a photosensor, a tamper switch, a GPS device, assets tag, a glucose meter, a blood pressure meter, a personal emergency response system ("PERS") pendant, and a smart phone.

According to another embodiment of this aspect, profile data includes at least one of information related to an occupant of the premises, a pet kept on the premises, smart phone data, structural details of the premises and geographic information associated with the premises. According to another embodiment of this aspect, the statistical data includes at least one of previous event data, trends of previous event data, biometric data, crime data and news data.

According to another embodiment of the invention, a device for analyzing an event at a premises is provided. The device includes an analysis module configured to receive first event data related to the event at the premises, receive verification data related to the event at the premises, analyze the first event data in conjunction with the verification data, generate, based on the analysis, an indication of a likelihood that the event is an alarm event, and initiate at least one action based on the indication. According to another embodiment of this aspect, the analyzing of the first event data in conjunction with the verification data includes determining a first predefined alarm value associated with the first event data, determining at least one second predefined alarm value associated with the verification data, and adding the first predefined alarm value and the at least one second predefined alarm value to generate the probability that the event is an alarm event. The indication of the probability that the event is an alarm event includes at least one of a percentage value representing a probability of whether the event is an alarm event, a color scheme representing one of a plurality of predefined levels of probability of whether the event is an alarm event, and one of a plurality of predefined levels of probability of whether the event is an alarm event.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION

Figure 1:
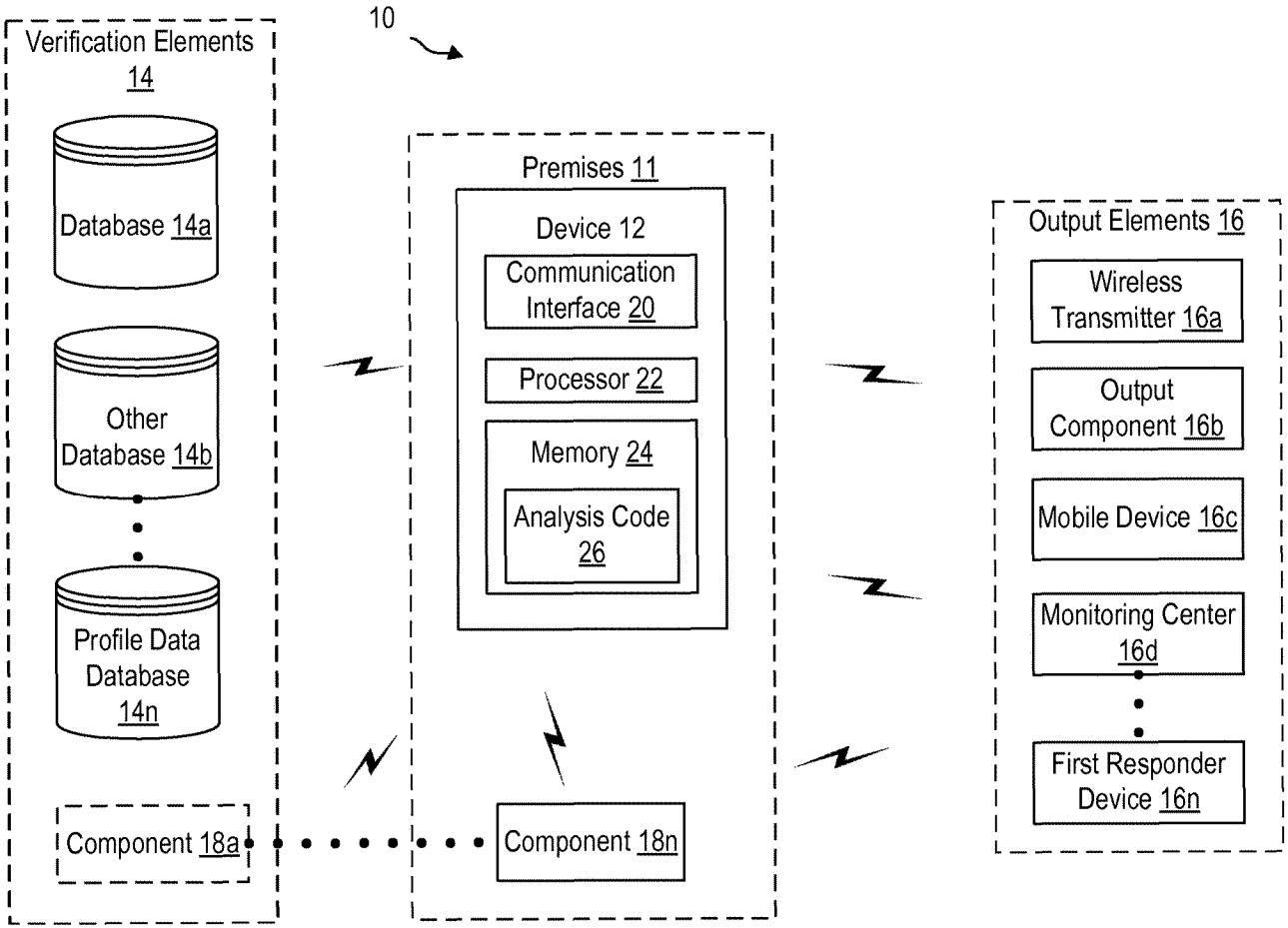
FIG. 1 is a block diagram of an exemplary embodiment of a system for verifying an alarm event in accordance with the invention.

For simplicity and ease of explanation, the invention will be described herein in connection with various embodiments thereof. Those skilled in the art will recognize, however, that the features and advantages of the invention may be implemented in a variety of configurations. It is to be understood, therefore, that the embodiments described herein are presented by way of illustration, not of limitation.

Before describing in detail exemplary embodiments that are in accordance with the disclosure, it is noted that the embodiments reside primarily in combinations of apparatus/node, devices and processing steps related to providing verification of an alarm event. Accordingly, components have been represented where appropriate by conventional symbols in drawings, showing only those specific details that are pertinent to understanding the embodiments of the disclosure so as not to obscure the disclosure with details that will be readily apparent to those of ordinary skill in the art having the benefit of the description herein.

As used herein, relational terms, such as "first," "second," "top" and "bottom," and the like, may be used solely to distinguish one entity or element from another entity or element without necessarily requiring or implying any physical or logical relationship or order between such entities or elements. The terminology used herein is for the purpose of describing particular embodiments only and is not intended to be limiting of the concepts described herein. As used herein, the singular forms "a", "an" and "the" are intended to include the plural forms as well, unless the context clearly indicates otherwise. It will be further understood that the terms "comprises," "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

In embodiments described herein, the joining term, "in communication with" and the like, may be used to indicate electrical or data communication, which may be accomplished by physical contact, induction, electromagnetic radiation, radio signaling, infrared signaling or optical signaling, for example. One having ordinary skill in the art will appreciate that multiple components may interoperate and modifications and variations are possible of achieving the electrical and data communication.

Referring now to drawing figures in which like reference designators refer to like elements there is shown in FIG. 1 an exemplary system 10 for verification of an alarm event. System 10 includes one or more devices 12, one or more verification elements 14*a*-14*n* (collectively referred to as verification element 14), one or more output elements 16*a*-16*n* (collectively referred to as output element 16) and one or more components 18*a*-18*n* (collectively referred to as component 18). In particular, a premises may be monitored by an alarm monitoring system that includes device 12 and components 18, described below, among other devices and components.

Device 12 includes one or more communication interfaces 20 for communicating with verification element 14, output element 16 and/or component 18 via one or more networks or communication links. In one or more embodiments, communication interface 20 includes one or more transmitters/receivers or transceivers. Device 12 includes one or more processors 22 and memory 24 (and other related hardware known to those of ordinary skill in the art) that are used to process information and actuate the functionality of the invention and other functional elements of device 12 and to store information used therewith. This may include, for example, an application (app) running atop an operating system on processor 22 using volatile and/or non-volatile memory, e.g., memory stick, flash memory, random access memory, programmable logic arrays, among other volatile and/or non-volatile memory known in the art. For example, memory 24 may store analysis code 26, among other data, code and/or applications. Analysis code 26 includes instructions, which when executed by processor 22, causes processor 22 to perform the processes described herein, such as one or more analysis processes, discussed in detail with respect to FIGS. 2, 3 and/or 6. Those of ordinary skill in the art will appreciate that these functional elements may be implemented in various combinations of hardware and/or software, or can be all hardware such as application-specific integrated circuit (ASIC), programmable gate array (PGA), etc. Some of these combinations will be reference herein for illustration. The invention is not limited to those embodiments but only as set forth in the claims. In one or more embodiments, processor 22 and memory 24 are included in an analysis module for performing the functionality describe with respect to analysis code 26.

Verification element 14 generally refers to elements that provide information to device 12 such that device 12 may analyze event data in conjunction with verification data, as discussed herein. In one or more embodiments, verification element 14 is or includes database 14*a*. Database 14*a* may be associated with system 10 and may be configured to receive and store event data generated by components 18 as discussed below, verification data, the results of the analysis discussed below, the indication generated based on the analysis and/or information on any action initiated as discussed below. In one or more embodiments, database 14*a* may receive, store and/or exchange data with other databases 14*b* and/or one or more output elements 16 as discussed below.

Verification element 14 is or can include database 14*b* that is configured to store statistical data and/or secondary event data. Statistical data may include, for example, prior event data, trends, tendencies, prior analysis, and/or "big data" such as crime, weather, social media, current event, political, government or news data. For example, the statistical data may include at least one of previous event data, trends of previous event data, biometric data, crime data and news data. In one or more embodiments, database 14*b* is one or more of a law enforcement database, state database, federal database, foreign database, news services, search engine content, among other data. Secondary event data, i.e. verification data, may include, for example, concurrent event data from any other component 18 or element 14/16, which are proximate premises 11 or otherwise associated with premises 11. For example, the secondary event data may be from a component 18 such as a motion detector at premises 11, and or may be GPS data from another component 18 such as a smart phone belonging to an occupant of premises 11 showing that the device is away from premises 11—where primary/first event data was received from a door contact at premises 11.

Verification element 14 is or can include profile data database 14. Profile data database 14*n* includes information relevant to the occupants of premises 11 such as information on pets kept at premises 11, wireless asset tags, smart phone data, third party personal data, Melissa data, structural details of premises 11, geographic information relevant to premises 11, etc. In one or more embodiments, verification element 14 includes one or more components 18. In particular, one or more of a plurality of components 18 provide event data while the remaining one or more of the plurality of components 18 provide verification data, as discussed below. Verification element 14 is not limited to the elements shown in FIG. 1.

Output element 16 includes one or more devices, output components or centers that are configured to receive a command and/or notification from device 12 to trigger at least one component function based on the received initiation command and/or notification. Output element 16 may include one or more wireless transmitters 16*a*, one or more output components 16*b*, one or more mobile devices 16*c*, one or more monitoring centers 16*d* and/or one or more first responder devices 16*n*. In one or more embodiments, one or more output elements 16 are located within or proximate premises 11. Output component 16*b* may include a siren, strobe light, annunciator, door lock, water valve, lights, one or more controllable devices, one or more components 18 and/or other device capable of being actuated to perform one or more functions in response to receiving a command from device 12.

Component 18 is configured to provide event data on an event being monitored by alarm monitoring system for an alarm condition. Component 18, for example, includes any number of peripherals used with security, home automation, and/or telemedicine systems, such as a door contact, a window contact, a carbon monoxide detector, a smoke detector, a glass break detector, a motion detector, a video camera, an audio sensor, an accelerometer, a vibration sensor, a keypad, a pressure sensor, a humidistat, a thermostat or other temperature sensor, a fingerprint reader or other biometric device, an infrared image sensor or similar device, a vapor sensor, a wireless network router or other communication device, a photosensor or similar device, a tamper switch or other electromechanical actuator, a GPS device, active or passive assets tags (Bluetooth, RFID, and the like), an embedded processor in a "smart" appliance, a glucose meter, a blood pressure meter, a personal emergency response system ("PERS") pendant, "wearable" mobile devices and/or smart phones, etc.

Those of ordinary skill in the art will appreciate that device 12, verification element 14, output element 16 and component 18 are not limited in constructions as long as they perform the functions described herein. For example, in one or more embodiments, device 12, verification element, output element 16 and component 18 may be incorporated in hardware and/or software such as relational databases, Linux or other operating systems, flash memory, other forms of storage, embedded controllers, etc. In one or more embodiments, one or more functions of one or more of device 12, verification element 14, output element 16 and/or component 18 are performed by a controller or gateway at premises 11, at a computer server at a remote location such as monitoring center 16*d*, in a network cloud, system owner's mobile device such as mobile device 16*c*, etc.

Figure 2:
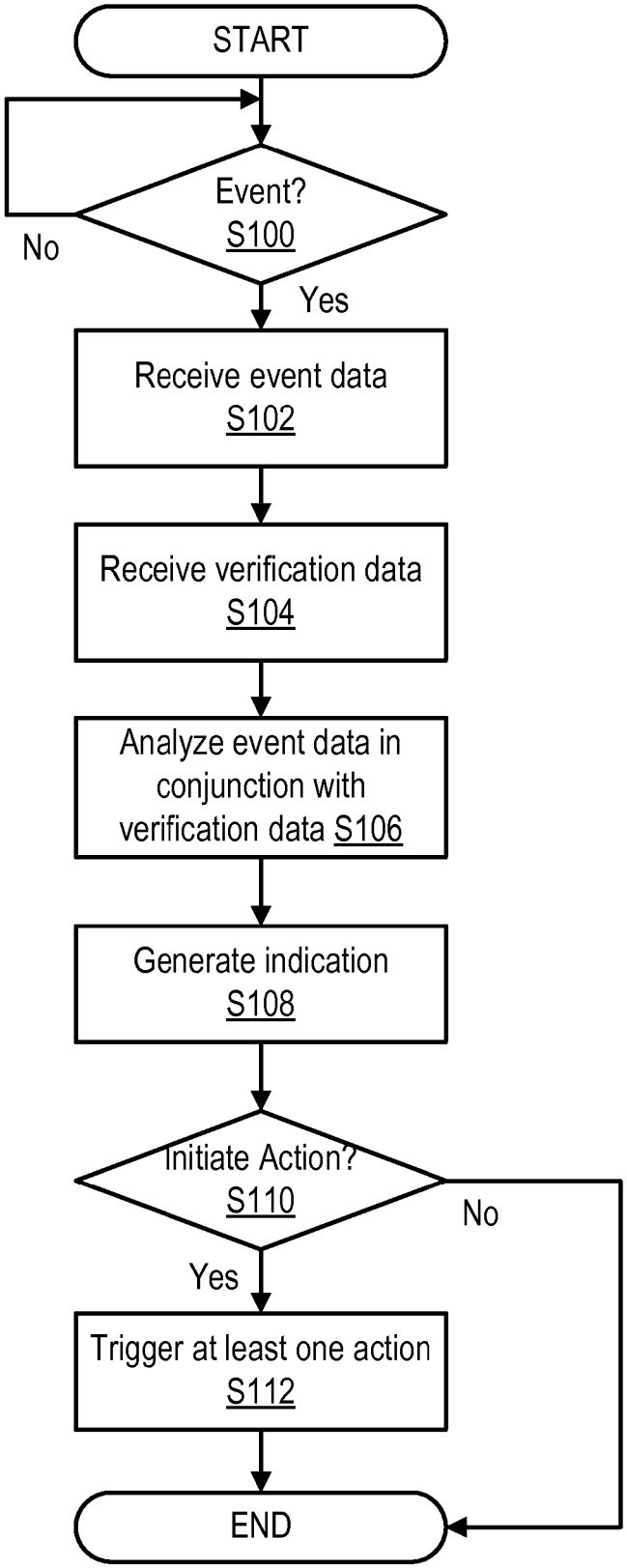
FIG. 2 is a flow diagram of an exemplary analysis process in accordance with the invention.

FIG. 2 illustrates a process flow of an analysis process in accordance of with the invention. In one or more embodiments, the analysis process of FIG. 2 is embodied as analysis code 26. Processor 22 monitors for events (Block S100). In one or more embodiments, processor 22 monitors one or more components 18 located within and/or proximate premises 11, and/or one or more components 18 associated with device 12. For example, processor 22 monitors smoke detectors, door contact sensors, among other components 18 to determine at least one predefined sensor threshold has been met, a sensor has triggered and/or a signal has been received from component 18 indicating an event has been detected.

If processor 22 determines an event has not occurred based on the monitoring, processor 22 repeats the determination of Block S100. If processor 22 determines an event occurred based on the monitoring, processor 22 receives event data (Block S102). In one or more embodiments, processor 22 receives event data such as one or more signals, measurements or other information from at least one component 18 that was triggered or that sensed the event. Processor 22 receives verification data (Block S104). In one or more embodiments, verification data is received from at least one verification element 14. Verification data corresponds to one or more signals, measurements or other information received from at least one verification element 14. In one or more embodiments, verification data is received from at least one component 18 that does not include the component(s) 18 that provided event data. In other words, in one or more embodiments, one or more components 18 provide event data while one or more of the remaining components 18 provide verification data. In one or more embodiments, event data is received from at least one type of component 18 while verification data is received from at least one different type of component 18 then from which event data was received.

Processor 22 analyzes event data in conjunction with verification data (Block S106). In one or more embodiments, the analysis of event data in conjunction with verification data includes assigning a predefined value to the event data. For example, the event data may be assigned a predefined value that serves as a starting point for the analysis. The predefined value may be a predefined percentage, predefined level, color, or other indicator that corresponds to a probability of whether the event is an alarm event. Further, the predefined value that is assigned to the event data may be based on an alarm category of the event data. For example, event data related to a fire may be assigned a higher predefined level to serve as a starting point for the analysis than the predefined level assigned to event data related to a burglary. In other words, in one or more embodiments, different predefined values are assigned to different event data related to different alarm categories.

The analysis further includes assigning one or more predefined values to verification data. In one or more embodiment, the at least one predefined value assigned to the verification data is based on the source of the verification data. For example, verification data received from component 18 is assigned a predefined value based on the component, e.g., motion sensors, and/or alarm category, e.g., burglary. In one or more embodiments, verification data may include signals or data from verification elements, e.g., components 18, which have not been triggered such that this verification data is assigned a negative value, level or indication.

In one or more embodiments, verification data may include signals or data from verification elements, e.g., components 18, which have been triggered such that this verification data is assigned a positive value, level or indication. In one or more embodiments, verification data may include signals or data from various sources, i.e., verification elements, in which this data is assigned one or more positive predefined values and/or one or more negative predefined values based on the source of a portion of the data and/or alarm category of the portion of the data. One of ordinary skill in the art will recognize that the predefined values assigned to the verification data may be based on other criteria.

The one or more predefined values assigned to the verification data are added to the predefined values corresponding to the event data. In one or more embodiments, verification data that supports the indication that an alarm actually occurred is added to the predefined value assigned to the event data while verification data that does not support the indication that an alarm actually occurred is subtracted from the predefined value assigned to the event data, thereby generating a final value. In other words, the analyzing of the first event data in conjunction with the verification data includes determining a first predefined alarm value associated with the event data, determining at least one second predefined alarm value associated with the verification data, and adding the first predefined alarm value and the at least one second predefined alarm value to generate the likelihood that the event is an alarm event.

Processor 22 generates an indication whether the event is an alarm event (Block S108). For example, processor 22 generates an indication as to whether the event is an alarm event in which the indication indicates the final value of the analysis. Processor 22 determines whether to initiate action (Block S110). In one or more embodiments, processor 22 determines whether to initiate action based on the final value of the analysis such as by comparing the final value to a predefined threshold. In one or more other embodiments, processor 22 initiates action irrespective of the final value but communicates the final value or indication of the final value to one or more devices and/or elements 16. If processor 22 determines to initiate an action, processor triggers at least one action (Block S112). In one or more embodiments, the at least one action includes at least one of updating the verification data, initiating a home automation, adjusting a home automation profile, actuating an alarm indicator, notifying at least one contact, notifying a monitoring center, notifying at least one first responder device, and transmitting the indication and at least a portion of the event data. For example, processor 22 triggers an alarm annunciator, notification to a system owner or other designated contact, notification of a monitoring center, notification of at least one first responder and/or transmission of the indication and at least a portion of the even data. The notification may include a message indicating no response is needed or that establishing contact with an occupant of premises 11 is sufficient. The notification may also include at least a portion of the generated indication and/or request verification and confirmation by the recipient.

Further, event information and/or requests included in the notification may vary based on the analysis in Block S106. For example, a homeowner's system profile in profile data database **14*n* indicates that they have a dog. Database 14*a* contains verification data including historical analysis of multiple prior events confirmed as false alarms that occurred due to the system being armed in "armed-away" mode without disabling the motion detector covering an area where the dog is penned. Consequently, the customer has indicated in profile in profile data database 14*n* that an attempt should be made for them to confirm any alarm event arising in this situation. One afternoon, while the alarm monitoring system for premises 11 is armed, motion is detected by the same motion detector that produced the prior false alarms. In addition to sending the alarm event code information to the monitoring center, a message may be sent to the system owner via text message or SMS including "Motion sensor in zone 3 triggered an event 3:15 PM today. System 10 was in "armed-away" mode. No other sensors triggered an event around the same time. You have a pet listed in your profile for premises 11. Chance of an alarm event appears low. Can you confirm whether a first responder is needed?" An operator at a monitoring service center 16*d*** may also be provided with a similar message, indicating that the system owner has been prompted for verification. The operator can access the user's profile, and may wait a designated period of time before requesting a first responder dispatch.

The analysis process, i.e., verification method, described above, advantageously increases the reliability of the generated indication by performing analysis using both primary (triggering/event) event data and secondary (verification) data to determine a degree of confidence, i.e., final value, as to whether the event may be an alarm event, a false alarm—or even an expected event, e.g., an opening on the door contract for the front door id detected at 3:30 pm, which occurs each weekday around the time when the children return from school. In one or more embodiment, the analysis is performed using a rules engine consisting, for example, of logic functions, mathematical expressions, recursive algorithms for processing event data from a triggering event against verification data, i.e., the analyzing of the first event data in conjunction with the verification data includes running a rules engine to apply at least one rule to the event data and verification data to determine the probability that the event is an alarm event, the rules engine including at least one of logic functions and/or mathematical expressions. In one or more examples, one or more logic functions are applied to data in order to provide a degree of confidence, i.e., probability that the alarm is an alarm event. One example of a logic function includes at least one of AND, OR, NOT, NAND, NOR, XOR and XNOR such as (window door contact data) AND (motion sensor data)=(armed-away), which provides a high probability that the event is an alarm event if satisfied, or (window door contact data) AND (motion sensor data)=(armed-stay), which provides a low probability that the event is an alarm event if satisfied. One of ordinary skill in the art will understand that the invention is not limited to the above examples, and the rules engine can include one or more logic functions and/or mathematical expressions for processing data to generate the degree of confidence. Those of ordinary skill in the art will appreciate that use of the "triggering" event, i.e., event data, and verification data are used here for the purpose of explaining the operations of one or more embodiments of the invention, but which event data that is used and which verification data is used is not particularly limited.

The use of additional event data from other components 18 of the alarm monitoring system as verification data (i.e., "cross-zoning") and/or the use of profile data in profile data database 14*n* in the analysis process can provide significant advantages in reducing false alarms. For example, in one embodiment, event data may consist of information detected by a door contact or window contact component 18 associated with device 12. Those skilled in the art will recognize that as an isolated event, the actuation of a door contact or window contact may generate a false alarm due to a failure of the contact or the adhesive holding the contact in place, a legitimate detection of the status change of the door contact due to an occupant of premises 11 entering without disarming the alarm, or due to the door swinging open on its own, perhaps due to a gust of wind. Initiating action based solely on this event may be more likely to cause a false alarm than if this event is analyzed in conjunction with other event data, i.e., verification data, such as movement detected (or no movement detected) by a motion detector proximate in time to the alarm event data being detected based on the change in state of the door contact.

In another example, event data may consist of information from a motion detector, i.e., component 18, indicating the movement by a person inside premises 11. Those skilled in the art will recognize that if an alarm monitoring system is in an "armed-stay" mode, where all input components absent motion detectors may be configured to generate alarm events, no alarm will be triggered by event data input by the motion detector. However, if an alarm monitoring system is inadvertently armed in "armed-away" mode instead of "armed-stay" mode, normal movement by the occupant of premises 11 would generate an alarm event that is a false alarm. In this example, verification data consisting a lack of certain event data from other components 18, such as no door contact actuation (or a door opening occurred just after motion was detected instead of before), as well as statistical data such as whether the homeowner typically arms the alarm monitoring system in alarm-stay mode at that time of day may be analyzed to generate an indication with a lower probability that the event is an alarm event.

Alternatively, user profile in profile data database 14*n* may contain an indication that the system owner wants to be contacted first for confirmation if the alarm event is triggered by a motion detector, irrespective of the alarm mode. In this situation, device 12 may analyze event data from the motion detector with verification data that includes other event data (e.g., a door contact changing state just prior to motion detector covering the zoned area of that door contact) and the profile data (e.g., confirm first based on motion) to provide an indication of a higher probability of an alarm event that is sent to the system owner and the operator of the monitoring service center in a notification. The indication of the probability that the event is an alarm event includes at least one of a percentage value representing a probability of whether the event is an alarm event, a color scheme representing one of a plurality of predefined levels of probability of whether the event is an alarm event, and one of a plurality of predefined levels of probability of whether the event is an alarm event.

Those of ordinary skill in the art will also appreciate that component 18 and the other event data, i.e., verification data, is not limited, even in the context of conventional intrusion detection as the alarm being monitored. For example, verification data may be selected from other components 18 that are associated with premises 11, such as a wireless receiver's detection of a wireless device's unique network identification indicator, such as a MAC address, where the wireless device may be a cell phone, laptop, tablet, smart wearable device, etc. carried by a person at premises 11. Verification data may also be selected from profile data, which may include a list of permissible—or restricted—wireless devices, storing similar identification and authorization credentials for such devices. Analysis of event data from the motion detector by device 12 may utilize the other event data from the wireless receiver and profile data to generate an indication of the probability of an alarm event by taking in to consideration network identification and authorization credentials in profile data.

If the unique network identification indicator is included in an expected or allowed subset of profile, the indication may reflect a lower probability of an alarm event and may initiate one or more actions (Block S112) that are less likely to result in a dispatch of first responders for a false alarm, such as those previously noted (e.g., notifying the system owner or other contact, updating verification data to record at least a portion of indication, or initiating a home automation). However, should the unique network identification indicator be absent in profile data, the indication may initiate an action (Block S112) in accordance with a high probability of an alarm event, such as actuating an alarm annunciator, notifying a monitoring center 16*d*, notifying at least one first responder device 16*n*, and/or transmitting the indication and at least a portion of the event data.

In another example, if the unique network identification indicator is included in a subset of those precluded from access to premises 11 in profile data, analysis (Block S106) may generate an indication which includes an even higher probability of an alarm event, and may initiate an action (Block S112) more appropriate for an urgent alarm event, such as notifying a combination of first responders devices 16*n*, actuating an alarm annunciator (such as a siren or strobe at premises 11), or notifying the system owner or other contact of the danger of a detected known undesirable at premises 11. An illustrative example of such a situation may be a person known to the homeowner and formerly residing at premises 11, but now subject to a restraining order due to past actions.

If the unique network identification indicator is not part of profile in profile data database 14*n*, the rules engine may determine to select additional verification data from statistical data in database 14*a*, specifically in connection with an alarm monitoring system, or other database 14*b*, consisting of "big data" used for several applications. Those skilled in the art will recognize that expanding the analysis (Block S106) to include verification data from this broader set of statistical data has an advantage that it may generate a better indication of whether the event is an alarm event. For example, a unique network identification indicator associated with an undesirable unknown to the occupant of premises 11 may not be part of profile data, but may be part of "big data" included in database 14*a* specifically in connection with an alarm monitoring system, which may have stored previous other event data 104, i.e., verification data, as a result of the method initiating an action (Block S112) in the past, or stored in other database 14*b* which stores big data, such as a police or FBI database.

Those of ordinary skill in the art will appreciate that the use of profile data in the analysis, resulting indication, and selection of any actions to be initiated provides the advantage of further reducing the risk of dispatch of first responders for false alarms. In one or more embodiments, profile data includes at least one of information related to an occupant of the premises, a pet kept on the premises, smart phone data, structural details of the premises and geographic information associated with the premises. For example, the use of profile data regarding the expected presence of a pet at premises 11 in the previous motion detector example may precipitate the initiation of actions that have a lower risk of resulting in the unneeded dispatch of first responders. An appropriate action for device 12 to initiate in this example (which may itself be stored by the system owner as profile data) may include first contacting the occupant of premises 11, or if verification data, selected from statistical data in database 14*a*, indicates that no occupants are anticipated to be present at premises 11, initiated action (Block S112) may include actuating an alarm annunciator such as a siren designed to warn off a potential intruder, but without initiating other action that would otherwise be appropriate for an indication with a greater potential for a false alarm, such as notifying a monitoring center 16*d* or notifying a first responder device 16*n*.

In another embodiment, verification data selected from profile data may prompt an alarm monitoring system to actively scan and verify the presence of one or more wireless asset tags from an array of such tags associated by the system owner with high theft items such as vehicles, tool collections, weapons, appliances, safes, jewelry boxes, or electronics a premises. Wireless assets tags may include, for example, passive or active radio frequency identification (RFID) tags, low energy Bluetooth tags such as iBeacon, and the like. The invention is not particularly limited. Depending on which or how many of the tags in the array are detected by an alarm monitoring system, an indication reflecting a higher or lower probability of an alarm event may be generated and different actions (Block S112) to be initiated. Profile data may also indicate that if an asset tag associated with a particular item (e.g., a flat screen TV or a laptop) is not detected by the system, analysis (Block S106) may generate an indicator reflecting a high probability of an alarm event (even in the absence of other event data points suggesting an alarm event). That is, profile data in profile data database 14*n* may indicate for example that the alarm monitoring system periodically scan for the tags irrespective of whether alarm monitoring system is armed to detect an intrusion. If event data includes a change in state of any of the tags or certain tags (i.e., location change, movement, lack of response, etc.), then device 12 may determine an indication of a higher probability of an alarm event, and initiate any of the aforementioned actions (Block S112) as indicated in profile in profile data database 14*n* (e.g., activate a siren, notify the monitoring center or system owner, etc.).

Figure 3:
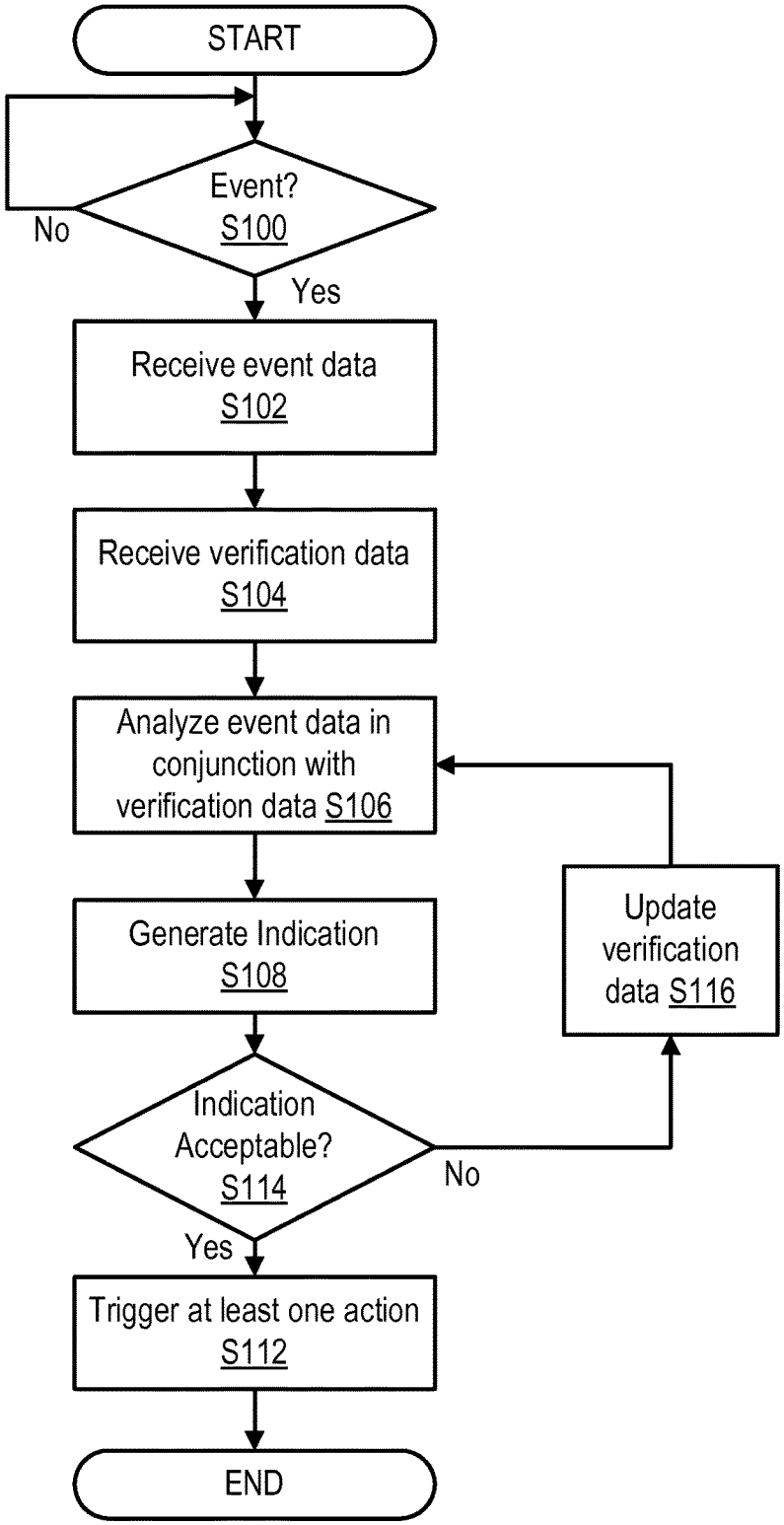
FIG. 3 is a flow diagram of another analysis process in accordance with the invention.

Referring to FIG. 3, there is illustrated another embodiment of the analysis process. In particular, this other embodiment includes a recursive or reiterative procedure/algorithm, or feedback loop that allows processor 22 to receive more verification data or updated verification data in order to help generate an acceptable degree of confidence, i.e., final value, for the indication. In other words, in one or more situations, a single execution of the analysis process of FIG. 2 may not generate an indication with a level of accuracy that is above or below a desired predefined or settable threshold value. Further, at least a portion of the results of the analysis and/or indication may be used in the recursive procedure/algorithm as an additional source of verification data for another iteration of the analysis process, thereby improving the quality and/or accuracy of the indication and further reducing the chance of a false alarm.

Those skilled in the art will also recognize that the advantage of ensuring the indication is of an acceptable degree of confidence, i.e., final value, prior to initiating an action, and this determination may be deduced from various types of verification data, at least a portion of the analysis/indication, and/or other factors. Even if the indication is acceptable for an instance of event data, it may be advantageous to retain this information itself as verification data for use with a future event at premises 11 to improve the quality of future analysis and indications. The portion of indication sent through the feedback loop may also differ depending on the determination if the indication is acceptable.

Referring now to the Blocks of FIG. 3, Blocks S100-108 and S112 correspond to like Blocks illustrated and described with reference to FIG. 2. Processor 22 determines whether the generated indication is acceptable (Block S114). In one or more embodiments, processor 22 determines whether the final value from the analysis or the indication of the final value meets a predefined threshold. For example, the probability of an event related to an intrusion at premises 11 is compared to a predefined value, i.e., the degree of confidence as to the event is an alarm event.

If processor 22 determines the indication is not acceptable such as if the indicated final value is below a predefined threshold, processor 22 updates verification data for the analysis (Block S116). Processor 22 may receive new or updated verification data from various components 18. For example, event data may correspond to a triggered event from a back door sensor in which verification data corresponds to a wireless network request in zone six of premises 11. Based on the event data and verification data, processor 22, in this example, processor 22 determines the indication is not acceptable such that processor 22 updates the verification data to include profile data that identifies a threat and data from passive infrared sensor (PR) motion sensors in the living room/zone two. Using the updated verification data, processor 22 performs the analysis of Block S106, and in one example, produces an acceptable indication in this example. Referring back to Block S114, if the indication is acceptable, processor 22 triggers at least one action (Block S112).

Figure 4:
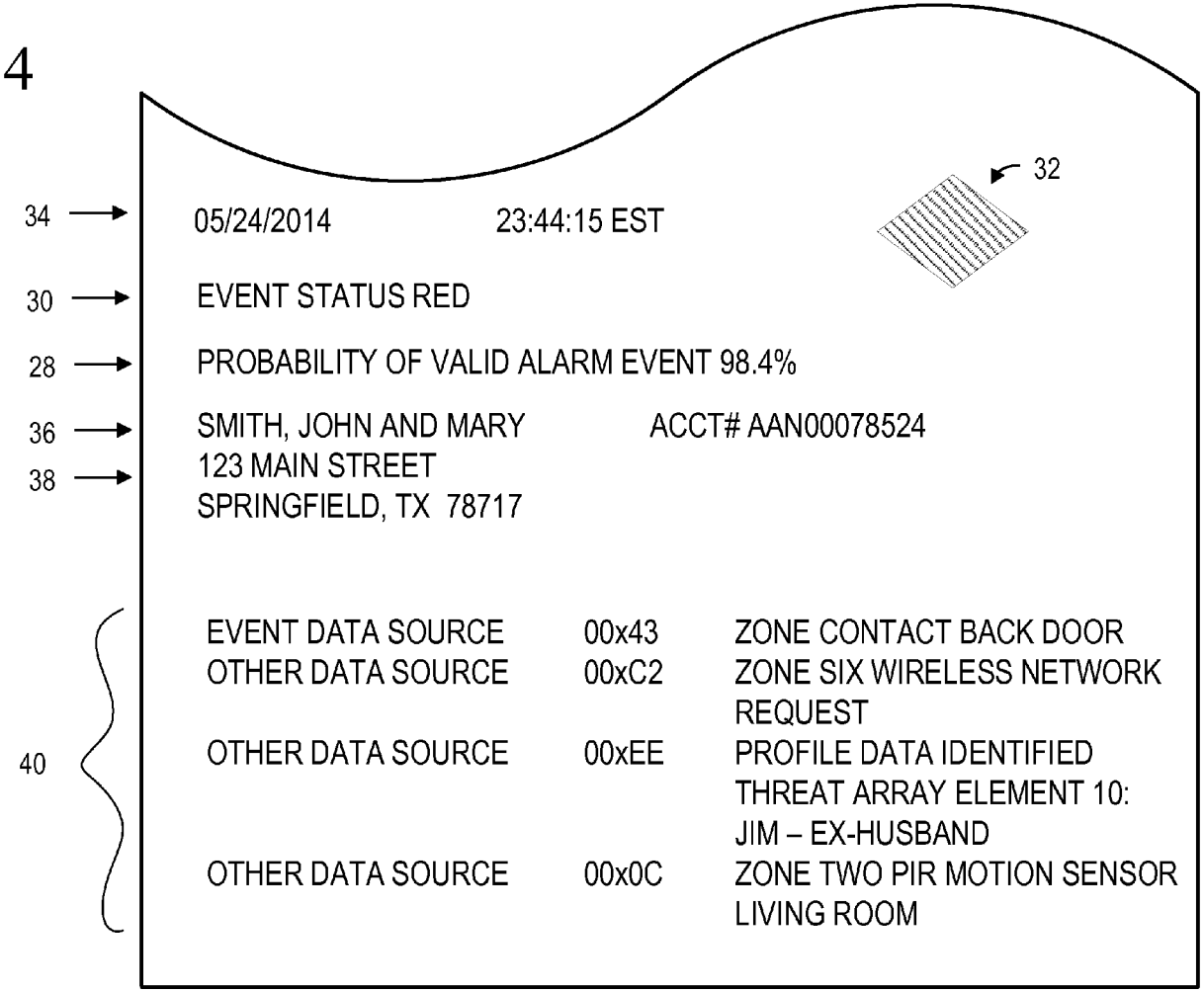
FIG. 4 is a block diagram of an exemplary generated indication in accordance with the invention.

FIG. 4 illustrates one embodiment of the generated indication. The indication may include various indicators such as percentage 28 representing a calculated confidence level, i.e., final value, of whether the event is an alarm event. Indication may also include a color 30 and/or pattern scheme 32 representing the level of confidence of whether the event is an alarm event. Indication may also include a time and date code 34 representing the instance of the event, customer or account identifier 36, premises identifier 38, and/or event identifier 40. Percentage 28 quantifies the likelihood that the event is an alarm event that was determined in the analysis process of Block S106.

Color 30 and pattern scheme 32 allow for a less granular, but more readily discernable categorization of the indication. Further, color 30 may be represented in many different number of ways such as text or a colored shape. In addition, a text embodiment of color 30 may be replaced by an array of words, suggestive of the degree of urgency associated with the indication. For example, color 30 contain "Red, Yellow, Green" may also be represented as "Emergency, Caution, Event", respectively. Similarly, colored shape or pattern 32 may use dimensions, quantity and perimeter of a shape to suggest a degree of urgency. For example, the indication possessing a high degree of urgency may have colored shape 32 with a large size as opposed to a medium or small size, three shapes as opposed to two or one shapes, or an octagon as opposed to a triangle or circle.

A time and date code 34, along with customer identifier 36, or premises identifier 38 may provide the recipient of output resulting from action initiated in Block S110 with information regarding when and where the event took place as well as who the event is likely to affect. Event identifier 40 may provide additional benefit by supplying a portion of the event data from components 18 and verification data from verification elements 14 used in analysis of Block S106. This information provides valuable information about the nature of the alarm event that can be used for further verification, or serve as source of verification data for use in future instances.

While one embodiment of the generated indication is illustrated in FIG. 4, those of ordinary skill in the art will recognize that other configurations of the indication that include more or less information/data shown in FIG. 4 may be used, so long as the indication indicates a likelihood or probability of whether the event is an alarm event.

Figure 5:
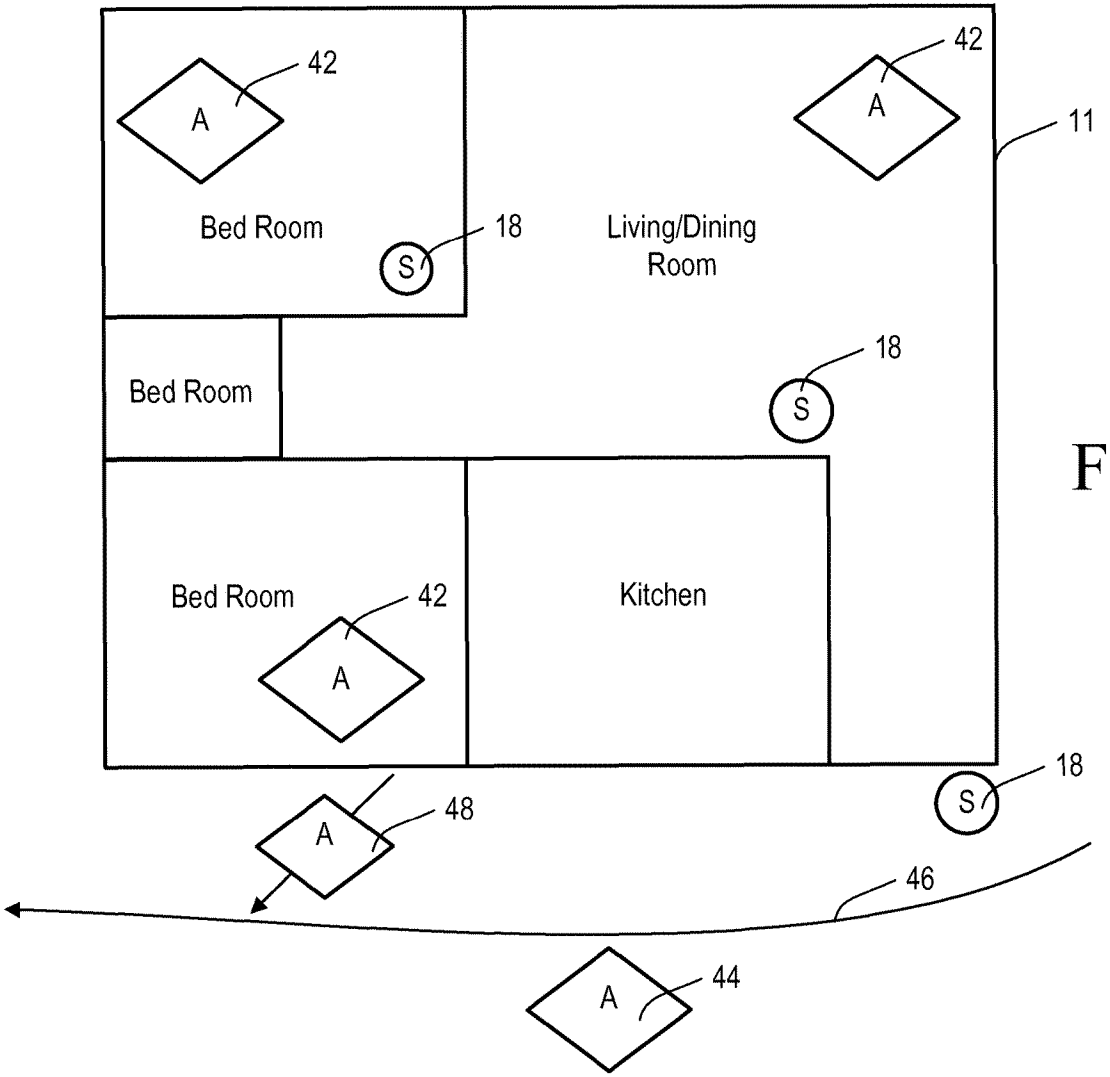
FIG. 5 is a block diagram of an exemplary embodiment of the premises in accordance with the invention.

FIG. 5 illustrates a set of components 18 that track the location of asset tags 42. This may be accomplished by a number of means such as GPS, "pinging," or triangulation of the radio signal to detect current motion or degree of displacement from an expected location at premises 11 stored as part of profile data. The operation of these means in and of themselves is well known to those of ordinary skill and will not be further elaborated upon here. This location information as event data and/or verification data from tagged assets 42 is analyzed by device 12 in connection with profile data, such as being found present in expected locations stored in profile data, may result in the generation of an indication with a lower probability of an alarm event. Conversely, other tagged assets 44, found outside a premises boundary 46 or in a transitory state 48 may result in the generation of an indication with a higher probability of an alarm event.

Such a wireless asset tag may also be associated with a pet or incorporated in to a pet wearable device. Those skilled in the art will recognize that pets may cause a motion detector or other component 18 to generate event data indicating an alarm event. The radio signal and identification information for the pet tag may use to verify the presence or motion by a pet indicated in profile data database 14*n*. The use of verification data in the form of statistical data provides further advantages for analysis (Block S106), generating a resulting indication and initiating selected actions. Those skilled in the art will recognize the value of using recursive algorithms, as described herein, to generate (and continually update) statistical data from prior analysis or events that may be stored in database 14*a*, in order to maximize its utility in future applications. The recursive algorithm may update statistical data to reflect adjustments to expected events. For example, event data routinely expected at 8:00 AM may begin to occur at gradually shifting later times. In order to maintain the maximum value of statistical data 14*a*, trend data may be updated to reflect the shift in the anticipated time of the event data. Those skilled in the art will recognize that accounting for this shift may be necessary in order to stay within a time frame during which the event is expected.

Transitory, periodic, or cyclical trend data may be used to analyze certain events. Such trend data may sometimes be more useful in conjunction with data from more recent events. In such case, trend data may be purged from statistical data if the analysis of current event data by device 12 indicates that previous trend data is no longer applicable. For example, if an occupant of premises 11 regularly activated a door contact at 4:00 PM during the months of August through May, coinciding with a traditional school year, recursive algorithm may update statistical data with the discontinued regular occurrence of this door contact actuation event during the summer months. If the regular occurrence resumed the following August, updates to statistical data may reflect a cyclical set of trend data. If the occurrences did not resume, updates to statistical data may reflect a periodic set of trend data. Trend data may be appended, amended, or purged in accordance with changes in the detection of recent event data representative of the presence or absence of trend data.

Device 12 may, based on the analysis and indication, initiate an action to notify the system owner or other contact requesting additional information to apply to statistical data. For example, an email or text message may be sent including "Routine activity in trend data indicates anticipated entry through the front door at 4:00. No occurrences of this event have occurred since May 31$^{st}$. Would you like to remove this expected event from your profile data?"

In yet another aspect of the invention, profile data may also be applied to statistical data. For example, if profile data in profile data database 14*n* includes information about the occupants of premises 11 indicating the presence of school age occupants, this profile data may be used to update statistical data to account for a periodic set of trend data as a subset of cyclical trend data, to be removed at the end of a pre-determined period (such as the end of a school year, or when the children reach a certain age). If the profile data did not indicate the presence of school age occupants, device 12 may initiate an action (Block S112) to notify system owner or a designated requesting additional information to apply to modifications of statistical data.

Statistical data stored in database 14*a* (associated with an alarm monitoring system) may also be combined with data from other database(s) 14*b* and stored in either or both of monitoring system database 14*a* and outside databases 14*b*. Those skilled in the art will recognize the utility of combined usage and communication between these kinds of database in order to maximize the utility of statistical data as applied to event data generated at a premises. For example, statistical data may incorporate weather data to analyze a brief occurrence of event data as the possible result of a storm or an earthquake. That is, a cause of window contacts, door contacts, vibration sensors, and motion detectors inputting event data simultaneously may be better understood in the presence of statistical data containing information regarding an earthquake near premises 11 coinciding with the time of the event.

In some situations, device 12 may conduct analysis of event data in connection with verification data and determine that none of the existing verification data reasonably aids in determining a degree of confidence for an indication that an event is an alarm event. In such a case, processor 22 may nevertheless initiate action to activate (or modify) a home automation as a preventative measure. For example, an isolated door contact, window contact, or other perimeter or exterior component 18 that provides event data when the system is not armed may result in initiating home automation in the form of turning on lighting, TV, or other device, closing blinds, locking doors, or actuating some other automation feature at premises 11 (e.g., based on user preferences stored in profile data) in an attempt to suggest the occupant's presence to a possible potential intruder, or otherwise make unauthorized entry to the structure less appealing. In such a situation, device 12 may also send a notification to the system owner or other contact indicating what was detected and the action taken, allowing the recipient to assess whether an alarm event may have occurred and if responsive action is needed—even though the alarm monitoring system itself was not armed. Statistical data may be updated with the occurrence of the event, contacts may be notified, profiles may be adjusted in anticipation of a repeat of the event data under similar future conditions thought to be likely based on statistical data.

Those skilled in the art will recognize that these initiated actions (Block S112) are examples that illustrate as a way to how the invention can improve the usefulness and accuracy of an alarm monitoring system beyond more traditional verification and reduction of false alarms of an alarm monitoring system in an "armed" state by preventing an alarm event all together through creating additional deterrents at the time of the event.

In another embodiment of the invention, verification data generated by a variety of people locator and/or identification systems may be used in analysis (Block S106). Those skilled in the art will recognize that these include, for example, automated video analysis in conjunction with "big data", facial recognition for precise identification of a person on a premises, or Wi-Fi sonar capable of determining size and motion of a person or object on a premises. Wearable devices such as cell phones, tablets, smart watches, or Google, Apple, Samsung, Jawbone, Nike, or Fitbit products may be also be used in providing GPS, geo-fencing, and other geo-tracking information for determining a precise location or identification of a person relative to a premises.

As an illustration, wearable devices may be used in place of access codes to change the arming state of an alarm monitoring system if detected as authorized to do so in profile data. When analyzing event data, device 12 may use this verification data to generate an indication with a low probability of an alarm event resulting from inadvertent, but permissible actuation of component 18 (e.g., a door contact, window contact, motion detector, proximity sensor). Based on this analysis and indication, device 12 may also initiate a number of actions (Block S112) to disarm the system, leave the system in an armed state but not sound annunciator, refrain from sending a notification with alarm event code information to the monitoring center (or send with indication), send a notification to the system owner or designated contact (which may also request verification before alarming), etc.

As another example, a people locator may be used as verification data in conjunction with event data from a camera, heat sensor, or motion detection as component 18 to distinguish a human form from a non-human form. For example, if event data from a camera or motion detection component 18 is analyzed in conjunction with verification data from a people locator indicating a human presence, then indication may reflect a lower probability of an alarm event when the person detected is indicated as permitted profile data or a higher probability when the person detected is not identified in profile data or indicated as not permitted in profile data. If a people locator indicates no human presence, risk of a false alarm may be reduced by generating indication with a lower probability of an alarm event, and taking one or more of the actions (Block S112) described above to verify whether an alarm event has occurred.

Similarly, a people locator may be used as verification data in conjunction with event data from component 18 including a window contact or door contact. For example, if a window contact or door contact is actuated and a people locator detects human presence at approximately the same time, it may be more likely that there is an alarm event. However, if a people locator indicates that there is no human presence at approximately the same time, it may be more likely that the event is not an alarm event and possibly due to a damaged contact, environmental trigger, or a pet dislodging the contact, door or window.

Figure 6:
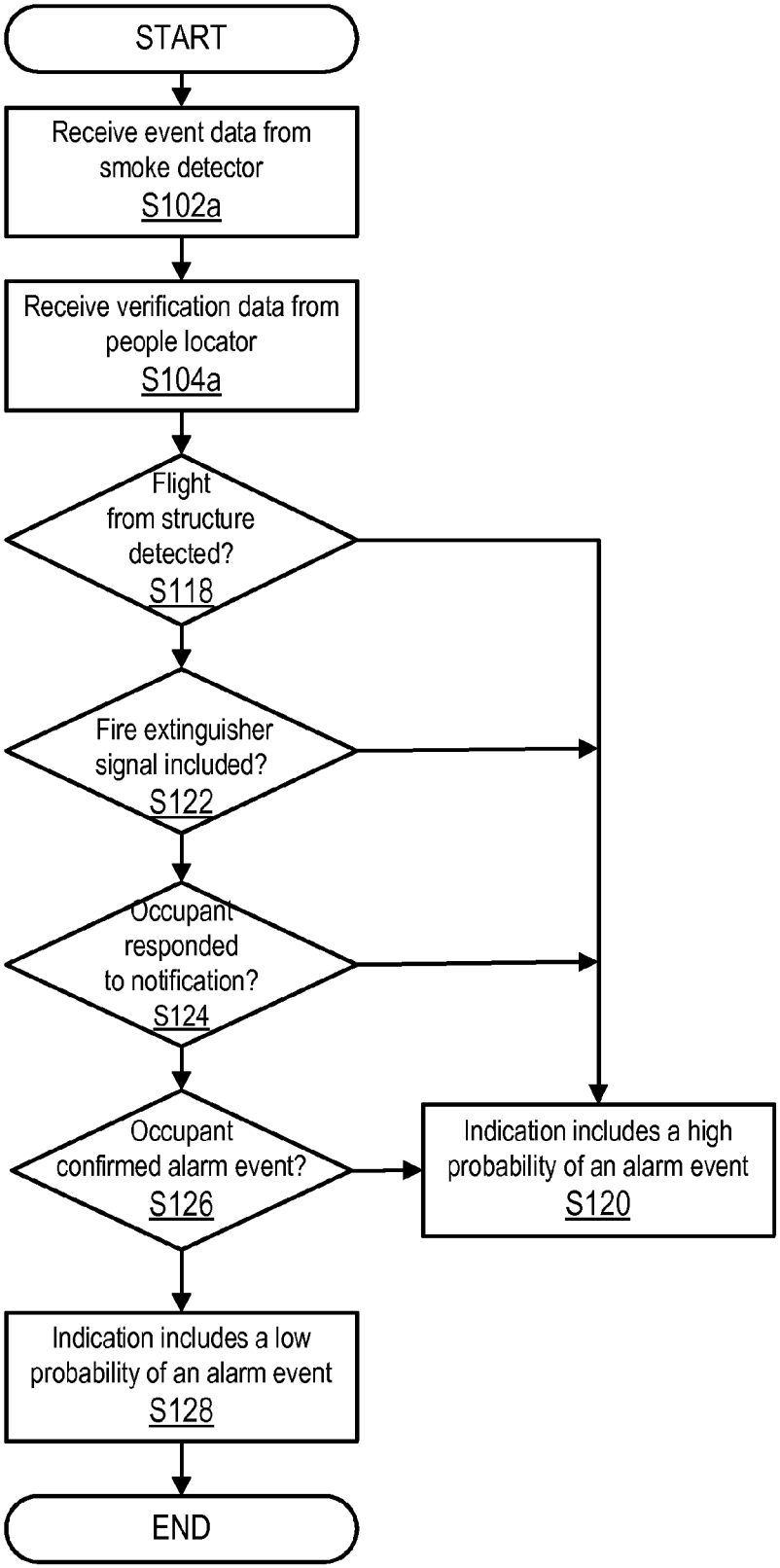
FIG. 6 is a flow diagram of another embodiment of the analysis process in accordance with the invention.

A specific embodiment of a portion of the analysis process is described in detail with respect to FIG. 6. In this embodiment, component 18 includes a people locator that provides verification data (Block S102) analyzed in conjunction with event data received from other components 18 such as a smoke detector (Block S104). Smoke detectors are often inadvertently "triggered" as a result of imperfect cooking methods. When this event data is analyzed in conjunction with a people locator data, indication of an alarm event may be improved by analyzing the relative change in location of an occupant of premises 11. For example, if processor 22 determines that people locator indicates flight from the structure (Block S118), the generated indication may include a higher probability of an alarm event (Block S120) and initiate action which may include notifying the monitoring center to request dispatch of at least one first responder device 16*n* (or notifying first responders directly). However, if processor 22 determines that people locator indicates that the occupant of premises 11 remains within the structure but other event data indicates action being taken (such as window or door being opened), the generated indication may include a lower probability of an alarm event (Block S128) in which Blocks S122-S126 are skipped or satisfied, and initiate action which may include updating verification data, notifying an the system owner or other contact requesting confirmation of an alarm event, and/or initiating home automation (such as turning on an exhaust fan).

Verification data from other components, such as a wireless transmitter located on a fire extinguisher, may also be analyzed (Block S122). This transmitter may be activated by using or making ready the fire extinguisher. If processor 22 receives verification data from fire extinguisher transmitter, the generated indication may include a higher probability of an alarm event (Block S120) and initiate action which may include notifying at least one first responder devices 16*n* (or notifying the monitoring center 16*d* to confirm with the system owner and/or request first responder dispatch). However, if the system does not receive verification data from a fire extinguisher transmitter, the generated indication may include a lower probability of an alarm event (Block S128) in which Blocks S124-S126 are skipped or satisfied, and initiate action which may include updating verification, initiating home automation such as turning on an exhaust fan, or notify an occupant or other contact requesting confirmation of an alarm event.

In another aspect of this embodiment, if there is no response to an attempted notification of an occupant but there is a response confirming an alarm event (Block S124-S126), then the generated indication may include a higher probability of an alarm event and initiate an action (Block S120), which may include direct notification of at least one first responder device 16*n* and/or notification of monitor center 16*d* for further action. Conversely, if the system receives a response from an occupant that does not confirm an alarm event, then indication may include a lower probability of an alarm event and initiate a less urgent action, such as updating verification data, or initiating home automation (Block S128). In the example of FIG. 6, Blocks S118-S128 are one embodiment of the analyze function of Block S106. In one or more embodiments, one or more Blocks S118-S126 may be omitted or skipped based on design need.

Figure 7:
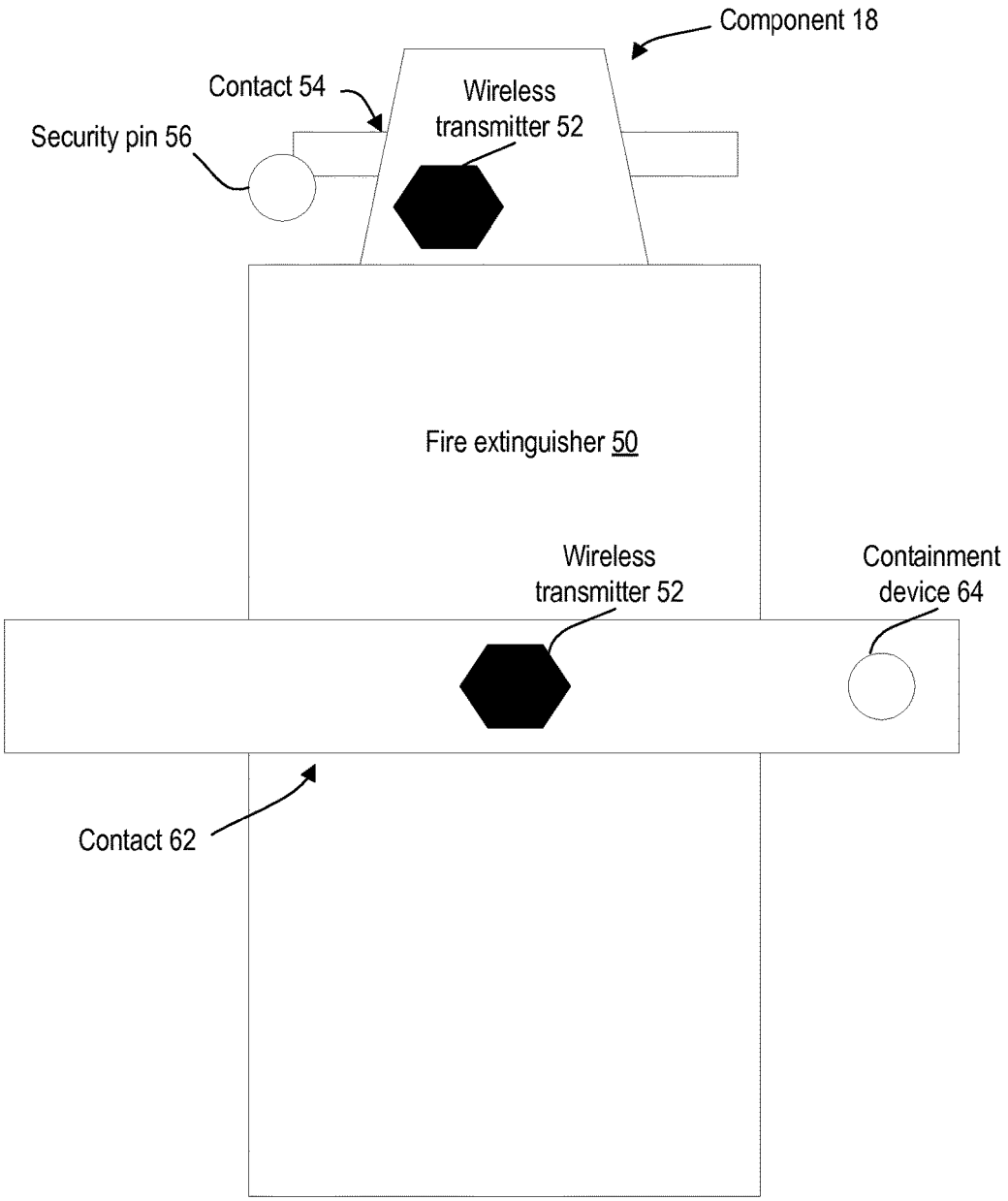
FIG. 7 is a block diagram of a component in accordance with the invention.

FIG. 7 illustrates one embodiment of component 18 as fire extinguisher 50. Fire extinguisher 50 is equipped with wireless transmitter 52 that may serve as a source of verification data. Wireless transmitter 52 may be located on fire extinguisher 50 and may be activated based on the change in state of contact 54, which may occur when fire extinguisher is activated by removing security pin 56. In another embodiment, wireless transmitter 52 may be located proximate the storage location of fire extinguisher 50, for example attached to a retention strap 60, and may be activated by the change in state of contact 62, which may occur when retrieving fire extinguisher 50 from a storage location by releasing retention strap 60 by removing or releasing containment device 64 such as a clasp, latch, buckle, or pin.

In yet another aspect of this embodiment, wireless transmitter 52 may serve as a source of verification data or event data when a change in its location at premises 11 is detected. For example, transmitter 52 may operate similarly to the wireless tagged assets described above and illustrated in FIG. 5. When event data or verification data is input from a smoke detector, device 12 may analyze the location of fire extinguisher 50 and the state of the smoke detector to determine an indication of a possible alarm event. This may also incorporate profile data, such as an expected location of fire extinguisher 50 in conjunction with the present location of fire extinguisher 50 or using triangulation, GPS, or another method to verify movement of fire extinguisher 50. Alternatively, wireless transmitter 52 may normally function in a state of transmission and become deactivated at the point it may have been activated in the examples above. In such an example, it may be detected as absent an array of tagged assets in profile data, resulting in the generation of an indication with a high probability of an alarm event, similar to the usage of tagged asset arrays described above.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope of the invention, which is limited only by the following claims.

What is claimed is:

1. A device for analyzing an event at a premises, the device comprising: a processor; and a memory configured to store executable instructions, which when executed by the processor, cause the processor to: receive first event data related to the event at the premises; receive verification data related to the event at the premises, the verification data being different from the first event data and including an identifier of a wireless device of a person; analyze the first event data in conjunction with the verification data, the analysis including determining whether the wireless device is permitted at the premises based on the identifier of the wireless device of the person; generate, based on the analysis, an indication of a probability that the event is an alarm event; initiate at least one action, at the premises, based on the indication of the probability that the event is the alarm event; and the analyzing of the first event data in conjunction with the verification data further includes: determining a first predefined alarm value to assign the first event data based on at least one of a source of the first event data and a category of the first event data; determining at least a second predefined alarm value to assign the verification data, the identifier of the wireless device of the person being preconfigured to correspond to the second predefined alarm value; and using both the first predefined alarm value and the at least the second predefined alarm value to generate an indication value, the indication value corresponding to the likelihood that the event is an alarm event.

2. The device of claim 1, wherein the indication of the probability that the event is an alarm event includes at least one of a percentage value representing a probability of whether the event is an alarm event, a color scheme representing one of a plurality of predefined levels of probability of whether the event is an alarm event, and one of a plurality of predefined levels of probability of whether the event is an alarm event.

3. The device of claim 1, wherein if the determination is made that the wireless device is permitted at the premises based on the identifier of the wireless device of the person, the initiated at least one action at the premises includes triggering a home automation device at the premises; and if the determination is made that the wireless device is not permitted at the premises based on the identifier of the wireless device of the person, the initiated at least one action at the premises includes triggering an alarm annunciator at the premises.

4. The device of claim 1, wherein if the determination is made that the wireless device is permitted at the premises based on the identifier of the wireless device of the person, the initiated at least one action at the premises being selected from a first set of actions;

if the determination is made that the wireless device is not permitted at the premises based on the identifier of the wireless device of the person, the initiated at least one action at the premises being selected from a second set of actions;

the first set of actions being different from the second set of actions; and the first set of actions reducing a likelihood that first responders will be dispatched for a false alarm when compared to the second set of actions.

5. The device of claim 1, wherein the at least one action includes at least one of initiating a home automation and actuating an alarm indicator.

6. The device of claim 1, wherein the first event data includes data from at least one of a door contact, a window contact, a carbon monoxide detector, a smoke detector, a glass break detector, a motion detector, a video camera, an audio sensor, an accelerometer, a vibration sensor, a keypad, a pressure sensor, a humidistat, a temperature sensor, a biometric device, an infrared image sensor, a vapor sensor, a wireless network router, a photosensor, a tamper switch, a GPS device, assets tag, a glucose meter, a blood pressure meter, a personal emergency response system (PERS) pendant, and a smart phone.

7. The device of claim 1, wherein the verification data further includes at least one of profile data, statistical data and second event data different from first event data; and the second event data includes data from at least one of a door contact, a window contact, a carbon monoxide detector, a smoke detector, a glass break detector, a motion detector, a video camera, an audio sensor, an accelerometer, a vibration sensor, a keypad, a pressure sensor, a humidistat, a temperature sensor, a biometric device, an infrared image sensor, a vapor sensor, a wireless network router, a photosensor, a tamper switch, a GPS device, assets tag, a glucose meter, a blood pressure meter, a personal emergency response system (PERS) pendant, and a smart phone.

8. The device of claim 7, wherein profile data includes at least one of information related to an occupant of the premises, a pet kept on the premises, smart phone data, structural details of the premises and geographic information associated with the premises.

9. The device of claim 7, wherein the statistical data includes at least one of previous event data, trends of previous event data, biometric data, crime data and news data.

10. A method for analyzing an event at a premises, the method comprising: receiving first event data related to the event at the premises; receiving verification data related to the event at the premises, the verification data being different from the first event data and including an identifier of a wireless device of a person; analyzing the first event data in conjunction with the verification data, the analysis including determining whether the wireless device is permitted at the premises based on the identifier of the wireless device of the person; generating, based on the analysis, an indication of a probability that the event is an alarm event; initiating at least one action, at the premises, based on the indication of the probability that the event is the alarm event; and the analyzing of the first event data in conjunction with the verification data further includes: determining a first predefined alarm value to assign the first event data based on at least one of a source of the first event data and a category of the first event data; determining at least a second predefined alarm value to assign the verification data, the identifier of the wireless device of the person being reconfigured to correspond to the second predefined alarm value; and using both the first predefined alarm value and the at least the second predefined alarm value to generate an indication value, the indication value corresponding to the likelihood that the event is an alarm event.

11. The method of claim 10, wherein the indication of the probability that the event is an alarm event includes at least one of a percentage value representing a probability of whether the event is an alarm event, a color scheme representing one of a plurality of predefined levels of probability of whether the event is an alarm event, and one of a plurality of predefined levels of probability of whether the event is an alarm event.

12. The method of claim 10, wherein if the determination is made that the wireless device is permitted at the premises based on the identifier of the wireless device of the person, the initiated at least one action at the premises includes triggering a home automation device at the premises; and if the determination is made that the wireless device is not permitted at the premises based on the identifier of the wireless device of the person, the initiated at least one action at the premises includes triggering an alarm annunciator at the premises.

13. The method of claim 10, wherein if the determination is made that the wireless device is permitted at the premises based on the identifier of the wireless device of the person, the initiated at least one action at the premises being selected from a first set of actions;

if the determination is made that the wireless device is not permitted at the premises based on the identifier of the wireless device of the person, the initiated at least one action at the premises being selected from a second set of actions;

the first set of actions being different from the second set of actions; and the first set of actions reducing a likelihood that first responders will be dispatched for a false alarm when compared to the second set of actions.

14. The method of claim 10, wherein the at least one action includes at least one of initiating a home automation and actuating an alarm indicator.

15. The method of claim 10, wherein the first event data includes data from at least one of a door contact, a window contact, a carbon monoxide detector, a smoke detector, a glass break detector, a motion detector, a video camera, an audio sensor, an accelerometer, a vibration sensor, a keypad, a pressure sensor, a humidistat, a temperature sensor, a biometric device, an infrared image sensor, a vapor sensor, a wireless network router, a photosensor, a tamper switch, a GPS device, assets tag, a glucose meter, a blood pressure meter, a personal emergency response system (PERS) pendant, and a smart phone.

16. The method of claim 10, wherein the verification data further includes at least one of profile data, statistical data and second event data different from first event data; and the second event data includes data from at least one of a door contact, a window contact, a carbon monoxide detector, a smoke detector, a glass break detector, a motion detector, a video camera, an audio sensor, an accelerometer, a vibration sensor, a keypad, a pressure sensor, a humidistat, a temperature sensor, a biometric device, an infrared image sensor, a vapor sensor, a wireless network router, a photosensor, a tamper switch, a GPS device, assets tag, a glucose meter, a blood pressure meter, a personal emergency response system (PERS) pendant, and a smart phone.

17. The method of claim 16, wherein profile data includes at least one of information related to an occupant of the premises, a pet kept on the premises, smart phone data, structural details of the premises and geographic information associated with the premises.

18. The method of claim 16, wherein the statistical data includes at least one of previous event data, trends of previous event data, biometric data, crime data and news data.

19. A device for analyzing an event at a premises, the device comprising: a processor; and a memory configured to store executable instructions, which when executed by the processor, cause the processor to: receive first event data related to the event at the premises; receive verification data related to the event at the premises, the verification data being different from the first event data and including an identifier of a wireless device of a person; analyze the first event data in conjunction with the verification data, the analysis including determining whether the wireless device is permitted at the premises based on the identifier of the wireless device of the person; generate, based on the analysis, an indication of a likelihood that the event is an alarm event; initiate at least one action, at the premises, based on the indication of the probability that the event is the alarm event; and the analyzing of the first event data in conjunction with the verification data further includes: determining a first predefined alarm value to assign the first event data based on at least one of a source of the first event data and a category of the first event data; determining at least a second predefined alarm value to assign the verification data, the identifier of the wireless device of the person being preconfigured to correspond to the second predefined alarm value; and using both the first predefined alarm value and the at least the second predefined alarm value to generate an indication value, the indication value corresponding to the likelihood that the event is an alarm event.

20. The device of claim 19, wherein if the determination is made that the wireless device is permitted at the premises based on the identifier of the wireless device of the person, the initiated at least one action at the premises includes triggering a home automation device at the premises; and if the determination is made that the wireless device is not permitted at the premises based on the identifier of the wireless device of the person, the initiated at least one action at the premises includes triggering an alarm annunciator at the premises.

* * * * *